US006692451B2

(12) United States Patent
Splane, Jr.

(10) Patent No.: US 6,692,451 B2
(45) Date of Patent: Feb. 17, 2004

(54) PASSIVE MOTION APPARATUS PROVIDING A CONTROLLED RANGE OF MOTION

(75) Inventor: Robson L. Splane, Jr., Granada Hills, CA (US)

(73) Assignee: Suncepts, Inc., Santa Monica, CA (US)

( * ) Notice: Subject to any disclaimer, the term of this patent is extended or adjusted under 35 U.S.C. 154(b) by 27 days.

(21) Appl. No.: 10/042,389

(22) Filed: Jan. 11, 2002

(65) Prior Publication Data

US 2003/0135137 A1 Jul. 17, 2003

(51) Int. Cl.[7] ..... A61H 1/02

(52) U.S. Cl. ..... 601/5; 601/24; 601/25; 601/26; 128/845; 606/245

(58) Field of Search ..... 601/5, 23–26, 601/34, 33, 35, 39; 606/237, 240–5; 128/845; 5/612, 613

(56) References Cited

U.S. PATENT DOCUMENTS

| | | | | | |
|---|---|---|---|---|---|
| 2,872,259 | A | * | 2/1959 | Thorpe | |
| 3,238,936 | A | * | 3/1966 | Siedentop | 601/19 |
| 3,620,210 | A | * | 11/1971 | Annas et al. | 606/245 |
| 3,674,017 | A | | 7/1972 | Stefani, Jr. | |
| 4,144,880 | A | | 3/1979 | Daniels | |
| 4,373,222 | A | * | 2/1983 | Wolfe et al. | 5/657 |
| 4,649,905 | A | * | 3/1987 | Barnes | 606/245 |
| 4,827,913 | A | | 5/1989 | Parker | |
| 4,953,541 | A | | 9/1990 | Parker, Jr. | |
| 5,035,234 | A | | 7/1991 | Forsythe | |
| 5,044,359 | A | | 9/1991 | Reinert | |
| 5,123,916 | A | | 6/1992 | Riddle et al. | |
| 5,171,260 | A | | 12/1992 | Mcllwain | |
| 5,258,019 | A | * | 11/1993 | Riddle et al. | 606/242 |
| 5,308,359 | A | * | 5/1994 | Lossing | 606/242 |
| 5,320,641 | A | | 6/1994 | Riddle et al. | |
| 5,500,002 | A | | 3/1996 | Riddle et al. | |
| 5,926,002 | A | * | 7/1999 | Cavanaugh et al. | 318/672 |
| 6,086,550 | A | | 7/2000 | Richardson | |
| 6,302,859 | B1 | | 10/2001 | Cushman | |
| 6,351,678 | B1 | * | 2/2002 | Borders | 700/83 |

* cited by examiner

*Primary Examiner*—Danton D. DeMille
(74) *Attorney, Agent, or Firm*—Larson & Taylor, PLC

(57) ABSTRACT

A passive motion exercise and/or treatment apparatus is provided which includes a main support assembly for supporting at least part of the body of a user of the apparatus. The assembly includes a first support member and a second support member disposed in a common plane. The second support member is pivotably connected to the main support member and is movable relative thereto so as to provide passive movement of a part of the body of a user supported by the second support member relative to a part of the body supported by the first support member. A separable leg support assembly is adapted to be connected, in use, to the main support assembly at either end so as to support the calves of the legs of the user in a plane parallel to, and elevated with respect to, the common plane while the apparatus provides the passive body movement referred to above. A motorized drive arrangement is used to provide the aforementioned relative movement of the second support member.

41 Claims, 10 Drawing Sheets

PASSIVE MOTION APPARATUS PROVIDING A CONTROLLED RANGE OF MOTION

FIELD OF THE INVENTION

The present invention relates to exercise and therapeutic devices and, more particularly, to passive motion devices, i.e., devices which put a passive user through prescribed movements without effort on the part of the user.

BACKGROUND OF THE INVENTION

It is estimated that in the United States alone, as of the mid-1990s, there were 25,000,000 people a day who suffered from some kind of back pain and that as many as nine out of ten Americans will suffer back pain at some time in their lives. The resultant total economic burden on industry in the United States is estimated at $40 to $50 billion annually.

One approach to relieving back pain and cervical pain is through exercise or therapeutic movement, and a substantial number of exercise devices and machines have been developed for exercising the back. However, many of these devices are unsuitable for persons suffering from serious back pain because use thereof tends to increase the pain and/or because there is danger of injury (or further injury) to the back, e.g., to the spine or to the supporting muscles.

One approach to exercising of the back and other parts of the body involves the use of passive exercise machines, i.e., machines that exercise muscles of the user (e.g., the back and abdominal muscles) without any active effort on the part of the user. A number of these devices and machines include separate support sections for supporting different parts of the body (e.g., the head and upper torso are supported on one section and the lower torso and legs on a second section) and are motorized so that, e.g., while the user lies flat on his or her back, the lower torso and legs are moved as a unit with respect to the upper torso and head which remain stationary, so as to provide automatic side flexion. Such machines include conventional "toning tables" as well as specially designed devices such as the "electric flexion distraction table" made by Health Care Manufacturing of Springfield, Mo. and the SPINALATOR® machine made by the Chattanooga Group, Inc. of Hixon, Tenn.

Patented devices of interest include those disclosed in U.S. Pat. No. 5,500,002 (Riddle et al.); U.S. Pat. No. 5,320,641 (Riddle et al.); U.S. Pat. No. 5,123,916 (Riddle et al.); U.S. Pat. No. 4,827,913 (Parker); U.S. Pat. No. 4,144,880 (Daniels); U.S. Pat. No. 6,086,550 (Richardson); U.S. Pat. No. 4,953,541 (Parker, Jr.); U.S. Pat. No. 5,044,359 (Reinert); U.S. Pat. No. 5,171,260 (Mcllwain); U.S. Pat. No. 5,035,234 (Forsythe); and U.S. Pat. No. 3,674,017 (Stefani, Jr.). Briefly considering some of these patents, the Riddle et al. patents all disclose passive exercise devices designed for the lower back region. The devices feature two sets of support means, one for the upper body and one for the lower body. The device is designed such that either one, or both of the two support means may be pivoted up or down. The Parker patent discloses a passive exercise device which includes interchangeable components adapted to be attached to the table apparatus. The device is deigned to provide leg exercises in a variety of different positions. The Daniels patent discloses a passive traction/motion device. A cervical traction device is also provided. The Richardson patent discloses a passive exercise device in which the patient may be reclined in the so-called "90/90" position described below. The legs of the patient are placed in a leg rest which may be removed from a table portion. The device provides a variable speed rocking motion (in an elliptical path) to the legs and torso of the user.

SUMMARY OF THE INVENTION

In accordance with the invention, a continuous passive motion apparatus or machine is provided which affords a number of important advantages. The invention is based, in part, on the appreciation that continuous passive motion, particularly when combined with traction, can be beneficial in treating various muscular and skeletal injuries or disorders, and on the belief held by many health care professionals that the slow and passive movement of an injured joint or like disorder can reduce pain and/or speed the recovery of many patients with such disorders.

According to a first aspect of the invention, a passive motion apparatus is provided, the apparatus comprising: a main support assembly for supporting at least part of the body of a user of the apparatus and including a first support member including a substantially horizontal support surface defining a plane and a second support member including a substantially horizontal support surface disposed in said plane, said second support member being pivotably connected to said first support member and being movable relative thereto such that movement of the second support member with respect to the first support member provides passive movement of a part of the body of a user supported by said second member relative to a part of the body supported by said first support member; a separable leg support assembly adapted to be connected, in use, to said main support assembly at either end of said main support assembly so as to support at least part of the legs of the user; and motorized drive means for providing said movement of said second support member relative to said first support member.

In one preferred embodiment of this aspect of the invention, the leg support assembly includes a support platform and a support strut for, when said leg support assembly is positioned at one end of said main support assembly so as to be disposed adjacent to said second support member, supporting said platform in a plane elevated with respect to the first-mentioned plane such that lower portions of the legs of the user are elevated with respect to the remainder of the body of the user and such that upper portions of the legs of the user extend at substantially right angles with respect to the lower portions of the legs and the trunk of the body of the user. Advantageously, the leg support assembly further includes means for pivotably mounting said support platform with respect to said support strut so as to enable angular adjustment of the support platform about the support strut.

In another embodiment, the leg support assembly comprises a leg support member defining an upper support surface and means for detachably affixing the leg support member to said main support assembly such that said upper surface of said leg support member is disposed substantially in said plane. Advantageously, the leg support member is adapted to be selectively connected to said main support assembly at either one of the two opposite sides of the main support assembly.

Preferably, the motorized drive means comprises an electric drive motor and control means for selectively controlling the operation of said motor. Advantageously, the control means comprises programmable means for controlling the motor so as to control the amount of pivoting movement of said second support member relative to said first support member.

The control means preferably includes a stop switch adapted to be operated by a user of the apparatus to terminate the relative movement of said second support member. In an advantageous implementation, the motor comprises a gear head motor and said drive means further comprises a worm screw mounted on said first support member and being driven in rotation by said motor, a traveling nut mounted on said worm screw for travel therealong in response to rotation of said worm screw by said motor, and a link pivotably connected to said traveling nut and to said second support member so as to cause said pivoting movement of said second support member in response to travel of said traveling nut along said worm screw.

Preferably, the passive motion exercise apparatus further comprises at least one temperature control pack removably disposed on one of said first and second support members. Advantageously, the temperature control packs comprise one of (i) at least one cold pack and (ii) at least one hot pack.

In a preferred implementation, the passive motion exercise apparatus further comprises a safety belt affixed to said second support member. Advantageously, a pair of laterally spaced hand grips are provided which are affixed to one end of said first support member but can be affixed to either support member.

In an advantageous embodiment, the second support member includes inflatable means, including first and second alternately inflatable sections, for providing rotational movement of a part of the body received thereon. The first and second sections preferably comprise first and second inflatable bladders disposed in side by side relation and said inflatable means further comprises an air pump and means for connecting the pump to said bladders so that the pump provides alternate inflation and deflation of said first and second bladders.

In a beneficial implementation, one of said first and second support members includes cervical rotation means for rotating the neck and head of a user. Preferably, the cervical rotation means includes a curved support member in which the head of a user is received, curved race, a plurality of bearings, disposed between said curved support and said curved race, for permitting movement of said curved support member relative to said race, and drive means for producing movement of said curved support member.

Advantageously, the passive motion apparatus further comprises traction means for supporting at least one part of the body of a user in traction.

In accordance with a further aspect of the invention, there is provided a passive motion exercise apparatus for exercising the back of a user by providing passive motion of the lower trunk and legs of a user relative to the remainder of the body of the user, the apparatus comprising: a first elevated support member for, in use, supporting, back down, the upper trunk and head of the user; a second elevated support member, movable with respect to said first support member, and disposed at a common level with, and adjacent to, said first support member, for in use, supporting, buttocks down, the lower trunk of the user; means for providing pivotable movement of said second support member in a common plane about a vertical axis disposed centrally of said first support member; and a third elevated support member, disposed in a plane elevated with respect to said common plane and disposed adjacent to said second support member, for supporting the lower portions of the legs of the user so that, in use, the upper leg portions of the user extend at substantially 90° to both the lower trunk of the user and the lower portions of the legs of the user.

Preferably, the third leg support member includes a support strut, a support platform and means for pivotably mounting said support platform with respect to said support strut so as to enable angular adjustment of the support platform about the support strut so as to change the position of the lower legs of the user.

Advantageously, at least one temperature control pack is removably disposed on one of said first and second support members, said at least one temperature control pack comprising one of (i) at least one cold pack and (ii) at least one hot pack.

Preferably, a safety belt is affixed to said second support member.

In accordance with another aspect of the invention, there is provided a passive motion exercise apparatus comprising: a main support assembly for supporting at least part of the body of a user of the apparatus and including a first support member including a substantially horizontal support surface defining a first plane and a second support member including a substantially horizontal support surface disposed in said plane, said second support member being pivotably connected to said first support member and being movable relative thereto such that movement of the second support member with respect to the first support member provides passive movement of a part of the body of a user supported by said second member relative to a part of the body supported by said first support member; a first, separable leg support assembly adapted to be connected, in use, to said main support assembly at either end of said main support assembly so as to support at least part of the legs of the user in a second plane elevated with respect to said first plane; a further, separable leg support assembly, for use when said first leg support assembly is not being used, said further leg support assembly comprising a leg support member defining an upper support surface and adapted to be connected, in use, to said main support assembly such that said upper surface of said leg support member is disposed substantially in said plane; and motorized drive means for providing said movement of said second support member relative to said first support member.

Preferably, said first leg support assembly includes a support platform and a support strut for, when said leg support assembly is positioned at one end of said main support assembly so as to be disposed adjacent to said second support member, supporting said platform in said second elevated plane such that lower portions of the legs of the user are elevated with respect to the remainder of the body of the user and such that upper portions of the legs of the user extend at substantially right angles with respect to the lower portions of the legs and the trunk of the body of the user. Advantageously, said leg support assembly further includes self-adjusting means for pivotably mounting said support platform with respect to said support strut so as to enable angular adjustment of the support platform about the support strut.

In accordance with a still further aspect of the invention, there is provided a passive motion apparatus for providing passive motion of the lower trunk and legs of a user relative to the remainder of the body of the user, the apparatus comprising: a body support unit comprising: a first support member for, in use, engaging the upper trunk and head of a user; a second support member, movable with respect to said first support member and disposed adjacent to said first support member, for, in use, engaging the buttocks of the user; a third support member, disposed adjacent to said second support member in a different plane therefrom, for engaging the lower portions of the legs of the user so that, in use, the upper leg portions of the user extend at substantially 90° to both the lower trunk of the user and the lower portions of the legs of the user; and means for providing lateral pivotable movement of said second and third support members relative to said first support member; and a stationary base for pivotably supporting said body support unit so as to enable pivoting of said body support unit between a first, substantially vertical position wherein a user is supported in seated posture on said body support unit and a second, substantially horizontal position wherein a user is supported in a reclining posture on said body support unit.

As in the other embodiments, the third support member preferably comprises a support strut, a support platform, and means for pivotably mounting said support platform with respect to said support strut so as to enable angular adjustment of the support platform about the support strut.

Preferably, the second support member extends outwardly at a non-zero angle with respect to said first support member so as to act as a seat in said first position of said body support unit.

In an advantageous implementation of this aspect of the invention, the body support unit includes a fourth support member interposed between the first and second support members and affixed to the second support member for movement therewith so as to undergo lateral pivotable movement with the second support member.

Further features and advantages of the present invention will be set forth in, or apparent from, the detailed description of preferred embodiments thereof which follows.

DESCRIPTION OF THE PREFERRED EMBODIMENTS

Figure 1:
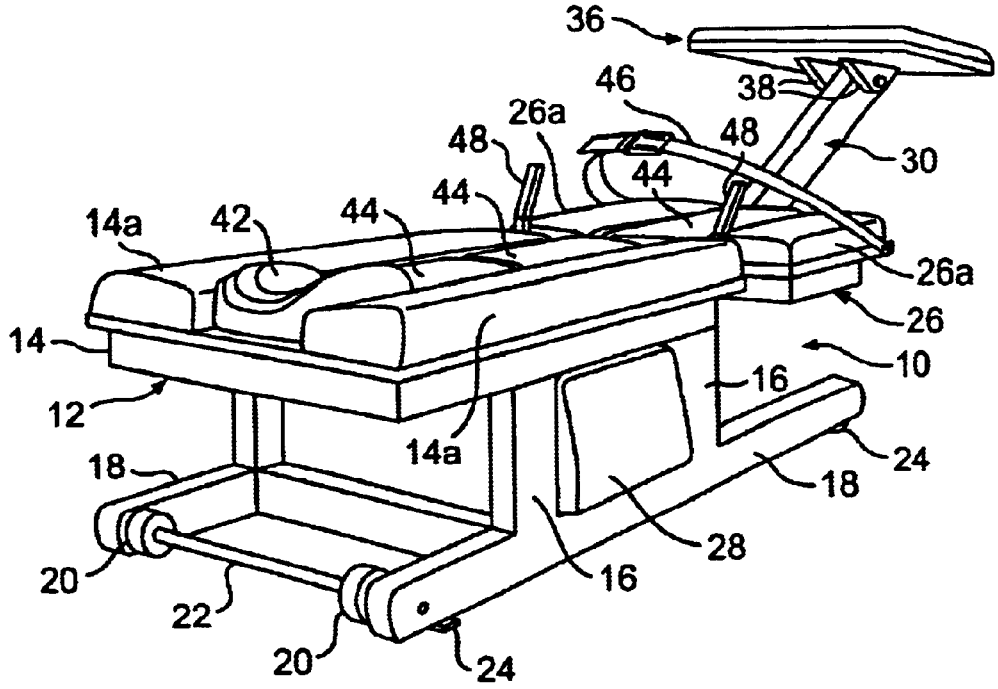
FIG. 1 is a perspective view of a passive range of motion exercise and/or treatment apparatus in accordance with a preferred embodiment of the invention.

Referring to FIGS. 1 to 6, there is shown a preferred embodiment of the continuous passive motion and traction device of the invention. As indicated in FIG. 1, the device or machine, which is generally denoted 10, includes a frame 12 including an upper main table member 14 supported by legs 16 or like supports in a sled configuration formed by parallel support members 18. Wheels 20 mounted on a transverse axle 22 extending between the front ends of support members 18 enable the device 10 to be moved. Downwardly depending, adjustable leveling elements or levelers 24 located at the ends of support members 18 help fix the device 10 in place as well as to level the device. Levelers 24 are provided at both ends of support members 18 in FIG. 1 and at only one end in FIG. 2 and either option can be used.

Figure 2:
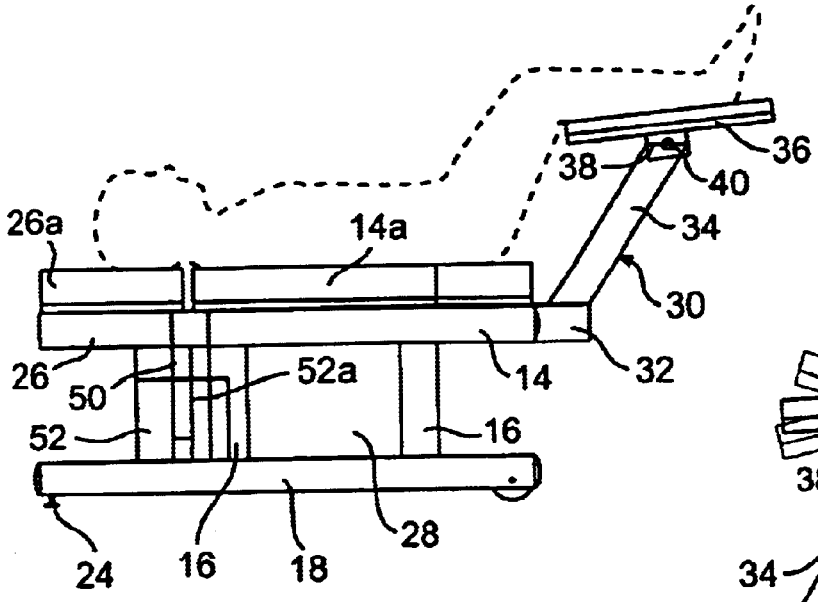
FIG. 2 is a side elevational view of the device of FIG. 1 showing a different component configuration.

In the configuration shown in FIG. 1, the overall support portion of device 10 includes the aforementioned main table member 14 and a further auxiliary, upper support member 26 which is located adjacent to the foot or distal end of main table member 14. Support member 26 is of a smaller size than, and is movable (pivotable) with respect to, table support member 14. In the configuration shown in FIG. 1, support member 26 is positioned at what would be considered the foot or distal end of table member 14, and, in this configuration, at the foot of device 10, as shown in FIG. 1. In another configuration, which is used to provide movement of the neck and head of the user, support member 26 is positioned at what would be considered to be the head or proximal end of the device 10, as shown in FIG. 2. As described hereinbelow, the particular relative orientation of support member 26 used is dictated by the mode of operation of device 10.

A control panel or control unit 28 is located beneath main table member 14, on one side thereof, between legs 16 as indicated in FIGS. 1 and 2. Control unit 28 contains an electrical control system for the operating mechanisms described below, including the controls of the simplified control circuit shown in FIGS. 7 and 8. It will be appreciated that the control panel or control unit can be a separate unit from the main apparatus and that the control unit can also be connected to an external computer device such as a PC.

Figure 3:
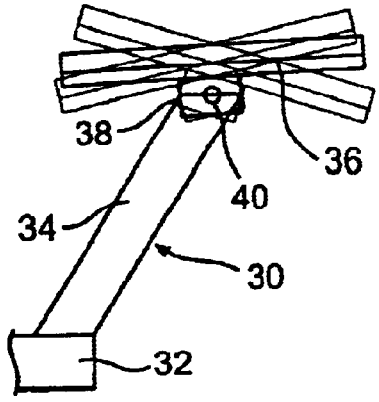
FIG. 3 is a side elevational view of the lower leg (calf) support assembly of FIGS. 1 and 2.
Figure 6:
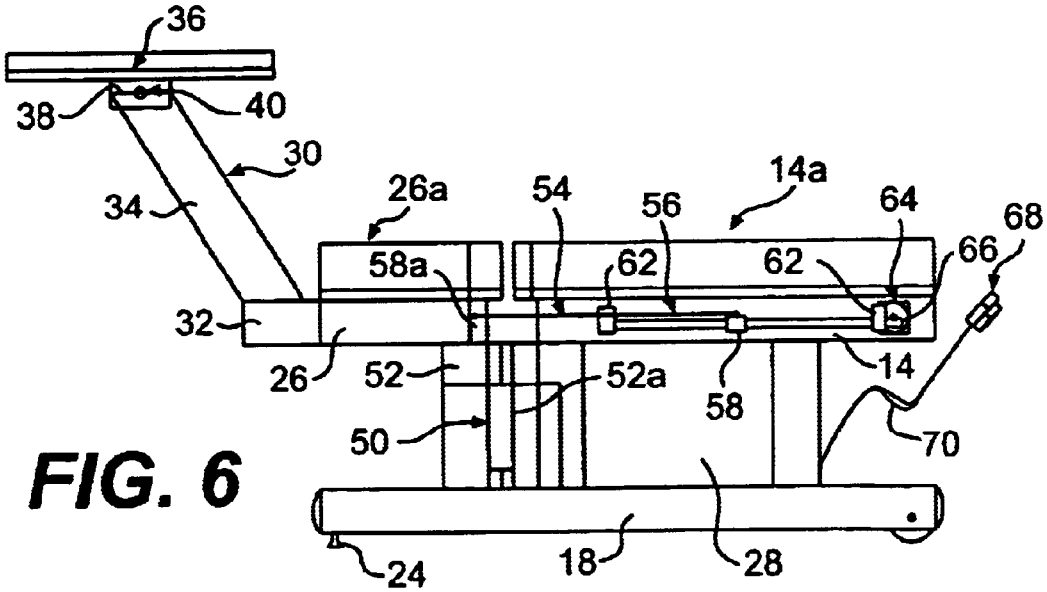
FIG. 6 is a side elevational view of the apparatus of FIG. 5.

An adjustable, self-adjusting lower leg (calf) support assembly 30 is also provided which can be moved to either end of device 10 in different modes of operation described below. Calf support assembly 30 can also be completely removed from the device 10 for shipping or storage. Calf support assembly 30 includes a base member 32 which includes conventional mounting means (not shown) for mounting base member 32, and thus the entire assembly 30, on either main table member 14 as shown in FIG. 2 or on auxiliary support member 26 as shown in FIGS. 1 and 6. The mounting means (not shown) can take a number of different forms and can, for example, comprise a shaped (e.g., square) mounting element (not shown) adapted to be non-rotatably and detachably received in a corresponding slot or sleeve (not shown) provided at the free end of each of the support members 14 and 26. Support assembly 30 further includes a connecting member or strut 34 and a support platform 36 which is of a double plate construction in the illustrated embodiment. A pair of mounting elements 38 (see FIG. 1) are secured to strut member 34 by a pivot pin 40 so as to enable pivoting of platform 36 about pivot pin 38, as indicated in FIG. 3. The mounting arrangement for platform 36 is such that the platform 36 can be pivoted by corresponding movement of the calves and feet of the user, and thus is readily self-adjusting, yet is still stiff enough that the platform 36 will remain in the position to which it is moved. Again, the pivotable mounting arrangement is conventional per se and it will be understood by those skilled in the mechanical arts that a number of different pivotable mounting arrangements are suitable for this purpose.

Figure 4:
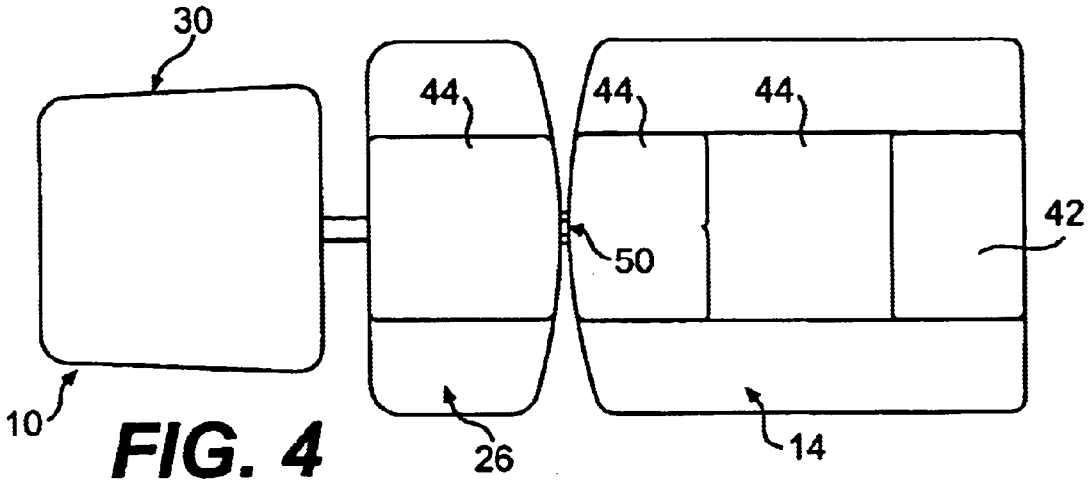
FIG. 4 is a top plan view of the apparatus of FIG. 1, showing certain optional features thereof.

As best seen in FIGS. 1 and 4, the table support member 14 and auxiliary support member 26 include spaced pairs of contoured pads 14*a* and 26*a*, respectively, mounted thereon. Further, in the exemplary embodiment illustrated, a head pillow 42 is disposed between pads 14*a* at one end thereof and a series of removable, replaceable hot and/or cold packs 44 are disposed between pads 14*a* and 26*a*, as illustrated in FIG. 4. Pads 14*a* and 26*a* are preferably fabricated of a contoured foam although other materials may be used. The hot and/or cold packs 44 are used to apply heat or cold to different parts of the body of the user (e.g., the back and buttocks or the sides and hips) as appropriate to his or her condition and treatment schedule (e.g., whether the application of heat and/or cold is prescribed in connection with a particular exercise or treatment regimen).

As indicated in FIG. 1, a seat belt 46, or like restraining belt or harness, is preferably provided on auxiliary support member 26 so as to hold the waist and hips in place during certain movements. In addition, in an optional embodiment also shown in FIG. 1, a pair of handle grips or hand grips 48 are provided which extend upwardly and outwardly from table member 14 at the end thereof adjacent to support member 26 so as to be grippable by a user during certain movements. The hand grips can also be provided on the support member 26 and this may be preferable in some applications.

As indicated above, auxiliary support member 26 is pivotable with respect to table member 14 and, to this end, an upright pivot shaft 50 is provided about which support member 26 pivots. As will be understood by those skilled in the mechanical arts, the overall pivoting arrangement can take a number of different conventional forms. For example, a simple arrangement can be used wherein a downwardly depending portion 52 of support member 26 includes a sleeve 52*a* which is affixed to the depending portion 52 that faces pivot shaft 50 and which fits around pivot shaft 50 to enable pivoting of auxiliary support member 26 relative to table support member 14.

Figure 5:
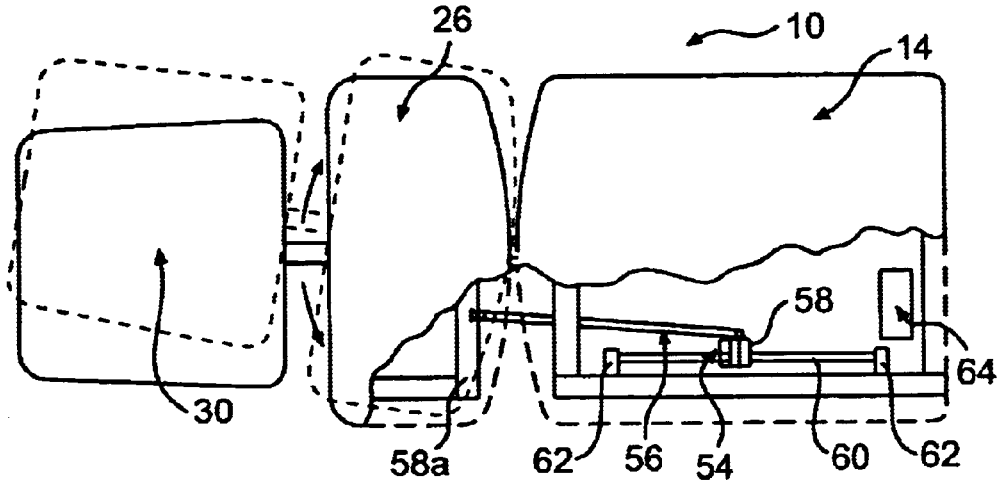
FIG. 5 is a further top plan view of the apparatus of FIG. 1, partially broken away to show the operating mechanism therefor and with the optional features of FIG. 4 omitted.

A preferred embodiment of the operating mechanism for pivoting support member 26 is generally indicated at 54 in FIGS. 5 and 6. The operating mechanism 56 includes a linkage member 56 which is pivotably connected at one end thereof to a frame portion 26*a* of support member 26 and at the end thereof to a traveling nut 58 mounted on a rotatable worm gear or screw 60 rotatably mounted in first and second spaced bushings 62. Gear or screw 60 is driven by a gear head motor 64 with an eccentric drive element 66. Rotation of screw 60 produces movement of traveling nut 58 therealong, with the direction of rotation of screw 60 determining the direction of travel of nut 58. This movement of nut 58 produces corresponding movement of linkage member 56 and thereby causes pivoting of support member 26.

It will, of course, be understood that other operating mechanisms can be used and, in this regard, in another, non-illustrated embodiment, the eccentric drive element 66 is used to drive a spring biased crank arrangement (not shown). The user can exert a resistive force against the springs (not shown) of this arrangement to provide interactive exercising of the body part in question, and an override feature can be provided, if desired, wherein the user can overpower the machine. It will, of course, be understood that the motor or drive unit that is used in these various embodiments can be other than an electric motor (e.g., a hydraulic motor or the like).

As indicated above, the electronic controls for motor 64 are housed within control panel or unit 28. As shown in FIG. 6, a remote control, hand operated switch device 68 is connected to control unit 28 by a cable 70 so as to enable the operation of the device 10 to be controlled by the user during use. In a preferred embodiment, switch device 68 is, or includes, a "kill" switch, i.e., a switch that enables the user to immediately stop operation of the device 10, and thus immediately terminate an exercise when, e.g., the user is feeling overtired or is suffering pain. Optionally, other functions, such as motor speed, can also be controlled by switch device 68.

Figure 7:
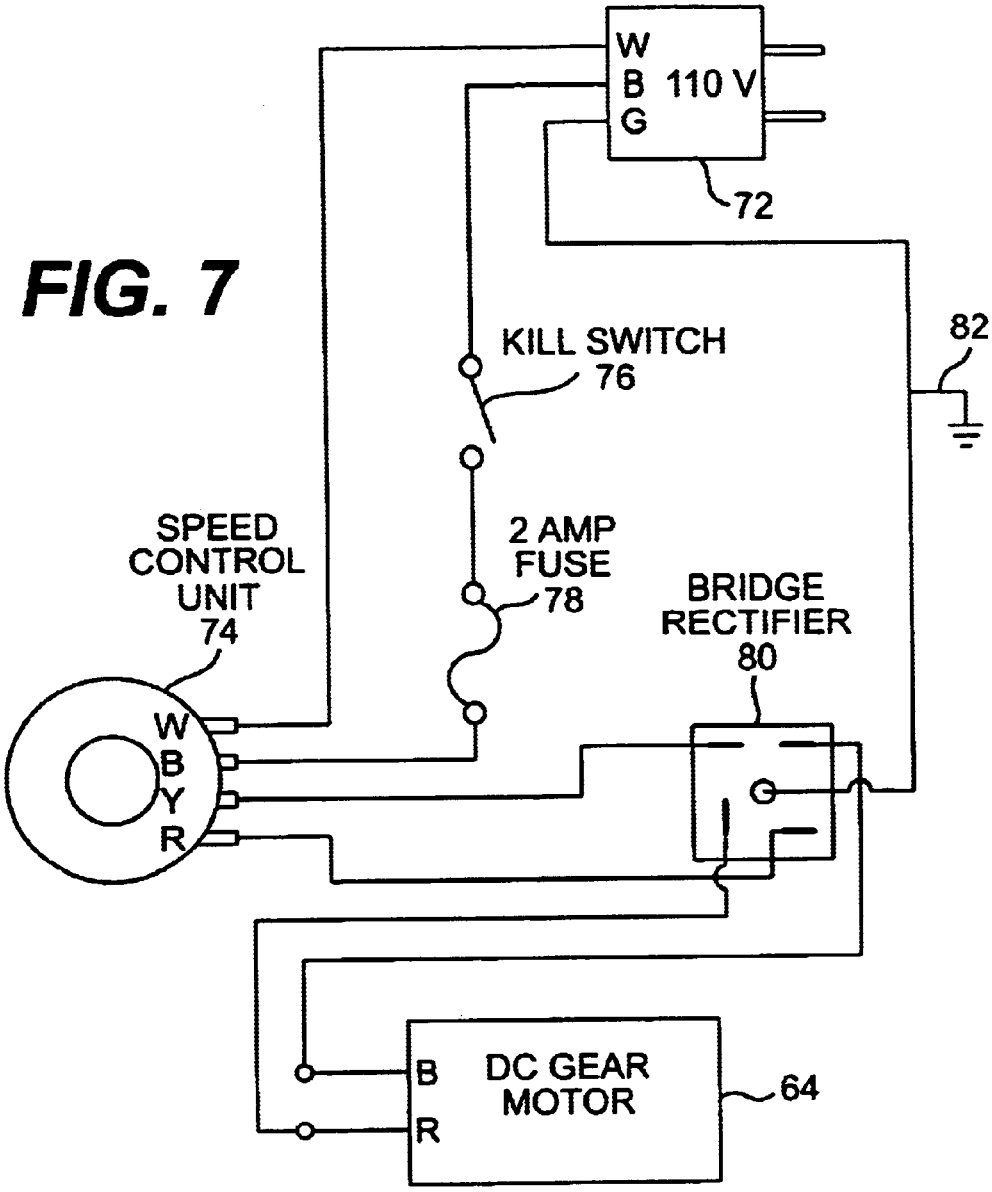
FIG. 7 is a schematic circuit diagram of a preferred embodiment of a control circuit for the apparatus of FIG. 1.

Referring to FIG. 7, a schematic circuit diagram of the motor control circuit is shown. The circuit includes a (110 volt) wall plug 72 two leads of which are connected to a speed control unit 74, with one lead (the B lead) being connected through a "kill" switch 76 and a fuse 78. Two output leads from speed control unit 74 are connected through a bridge rectifier unit 80 to the DC gear motor 64 mentioned above. A ground connection indicated at 82 is preferably made to the frame of device 10 through the mount (not shown) for the full wave bridge unit 80.

Figure 8:
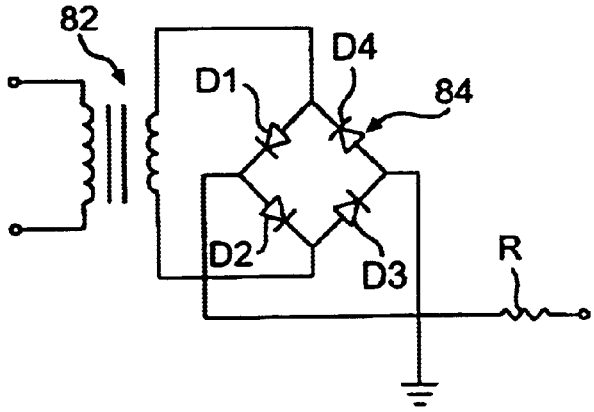
FIG. 8 is a schematic circuit diagram of a preferred embodiment of one unit (the bridge rectifier unit) of the circuit of FIG. 7.

A schematic circuit diagram of bridge rectifier unit 80 is shown in FIG. 8. As illustrated, unit 80 includes a transformer 82 connected to a full wave diode rectifier bridge 84 comprising diodes D1, D2, D3 and D4. The DC leads from bridge 84 is connected to motor 64, with the non-grounded lead being connected to motor 64 through a resistor R.

It will be understood that the control circuitry of FIGS. 7 and 8 represents a simplified control approach and, in preferred embodiments, more sophisticated adjustments would be provided for controlling speed, power, duration, volume and like parameters, depending on the nature of the operating mechanism used and the operating features desired.

Figure 9:
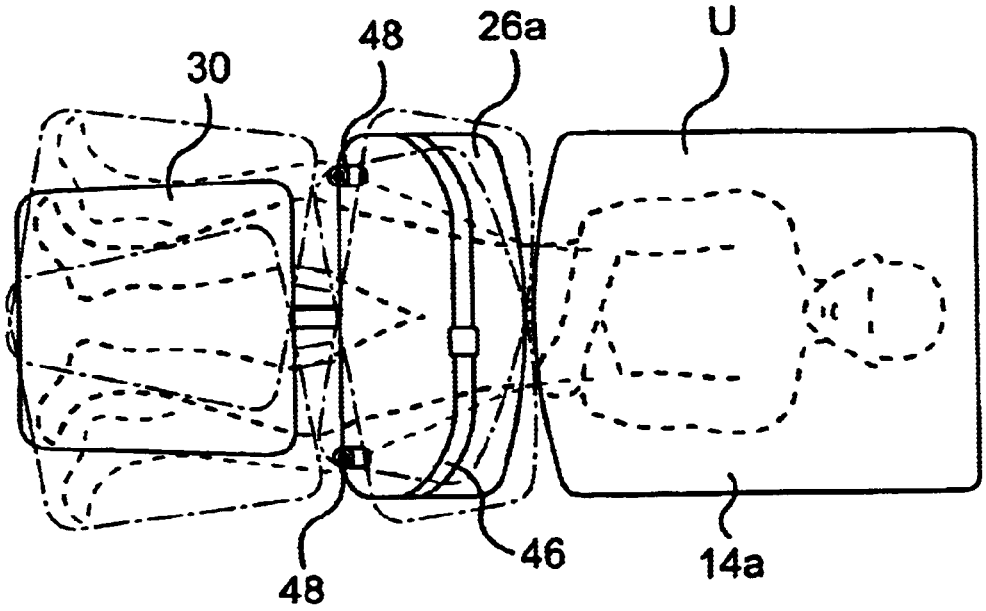
FIGS. 9 and 10 are a top plan view and a side elevational view, respectively, of the apparatus of FIG. 1, showing one mode of operation thereof.
Figure 10:
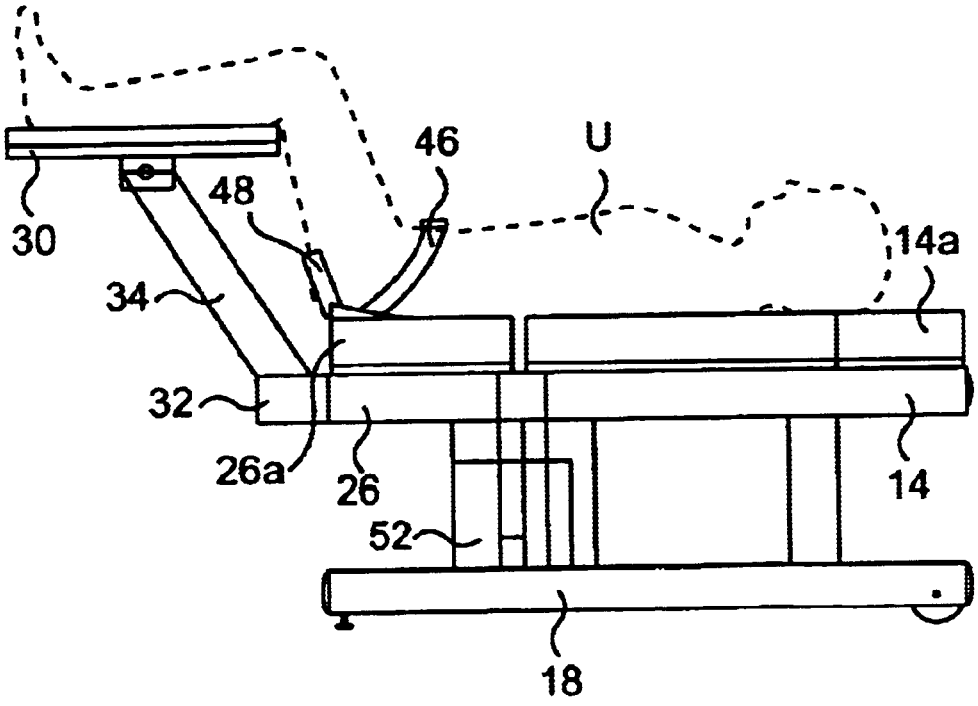

Referring to FIGS. 9 and 10, there is illustrated a first mode of operation of device 10. In this mode of operation, the user U is positioned in the "90/90" position referred to above, wherein the user U lies horizontally on his or her back on table member 14 and the lower legs are supported on platform 36 in a parallel horizontal plane. The buttocks are supported on auxiliary support member 26 in the same horizontal plane as the rest of the body trunk or torso, and both the trunk and lower legs are positioned at an angle of roughly 90° to the substantially vertical upper legs. This "90/90" position is widely regarded as the most comfortable for those with lower back pain.

In the illustrated configuration, the buttocks are, as indicated above, supported on auxiliary support member 26, with the user U being positioned between hand grips 48. Seat belt 46 is placed around the lower trunk to secure the user U in place. In this position, pivoting of support member 26, as indicated in dashed lines in FIG. 9, provides movement of the lower trunk through a limited range of motion and thus provides gentle exercising of the lower back. Stated differently, pivoting of support member 26 can provide from 0–20° (inclusive) of mechanically assisted lateral side flexion for the lumbar spine. It will be understood that the pivoting motion provided can be through the same angle on both sides, different angles on the two sides or on one side only. The general motion provided is widely accepted as being the most tolerable and potentially the most beneficial to individuals suffering from relatively severe back pain, while not producing user discomfort.

Figure 11:
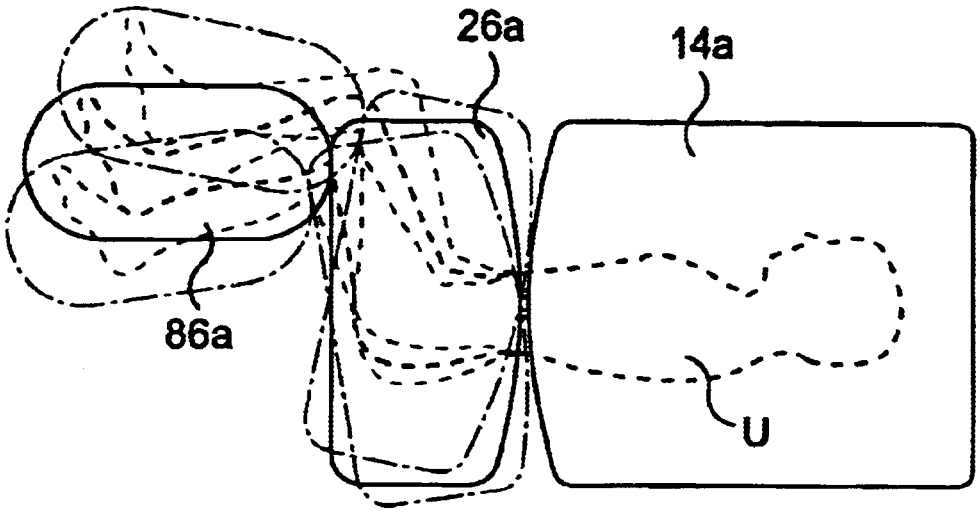
FIGS. 11 and 12 are a top plan view and a side elevational view, respectively, of a modified form of the apparatus of FIG. 1, showing a further mode of operation.
Figure 12:
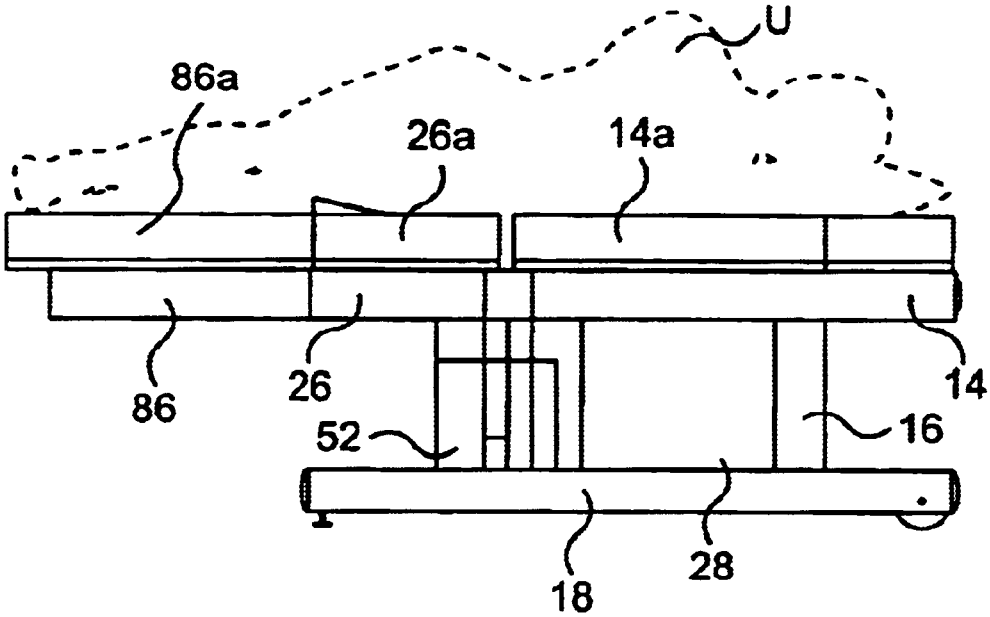

Referring to FIGS. 11 and 12 a further mode of operation is shown. In this embodiment, the lower leg (calf) support assembly 30 is not used, and a different leg support member 86 is provided. Leg support member 86 is adapted to be affixed to support member 26 at one side or the other and as in the other embodiment, a contoured pad or cushion 86*a* is disposed on support member 86. The connection between support member 86 and support member 26 can take a number of different forms. In one embodiment, this connection can comprise a simple rod and sleeve (or slot) connection wherein a downwardly depending portion of a rod (not shown) mounted on one of the two members 86 and 26 is received in a sleeve or slot (not shown) mounted on the other of the members 86 and 26. As indicated above, leg support member 86 is adapted to be mounted at either side of support member 26 so that the user U can be positioned on either side of his or her body. In the mode of operation illustrated, the user U lies on one side, and the hips and lower trunk together with the legs are pivoted relative to the rest of the body.

Figure 13:
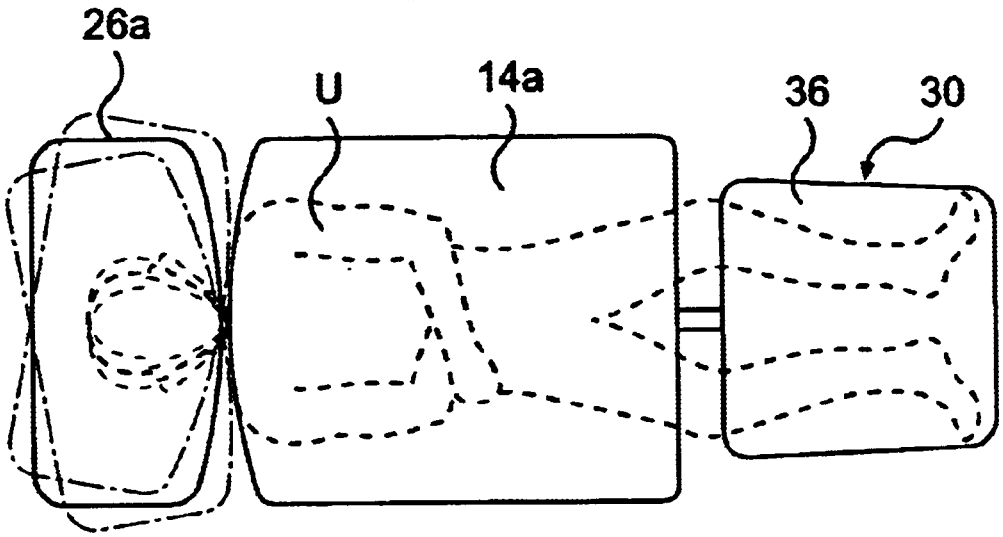
FIGS. 13 and 14 are a top plan view and a side elevational view, respectively, of a different configuration of the apparatus of FIG. 1, showing a further mode of operation.
Figure 14:
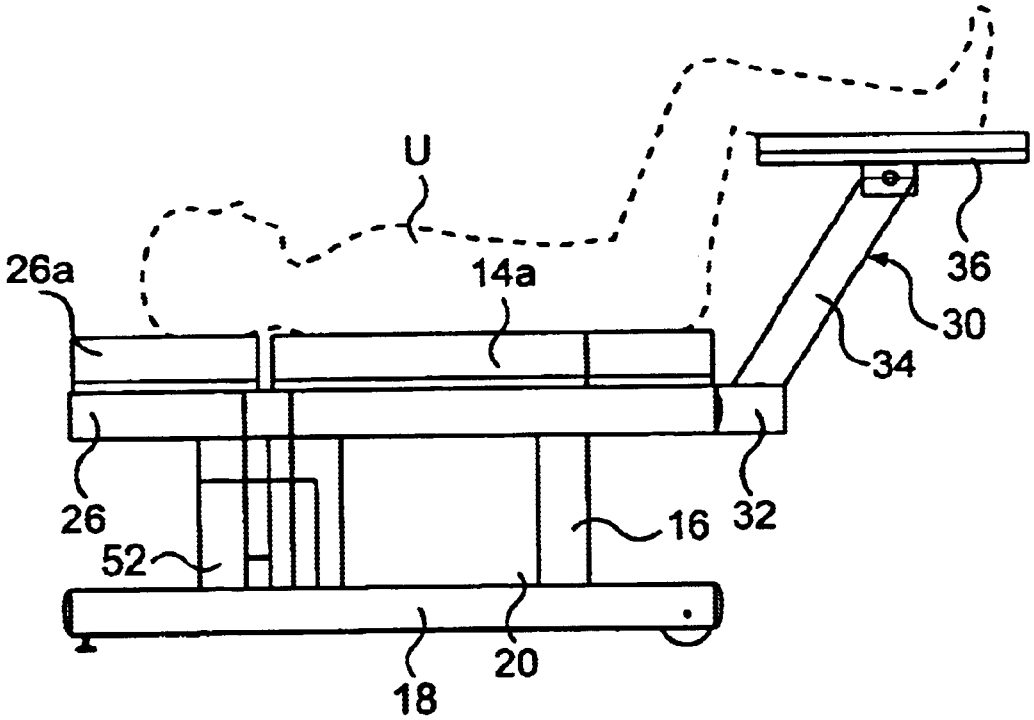

Referring to FIGS. 13 and 14, a further mode of operation is illustrated. In this mode of operation, which employs the configuration illustrated in FIG. 2, the leg (calf) support assembly 30 is not affixed to support member 26 but is rather affixed to the opposite end of table support member 14. The user U is thus supported in the "90/90" position as in FIGS. 9 and 10 but, in contrast to the mode of operation illustrated in FIGS. 9 and 10, the neck and head move relative to the remainder of the body through pivoting movement of support member 26, on which the head of the user U rests.

Figure 15:
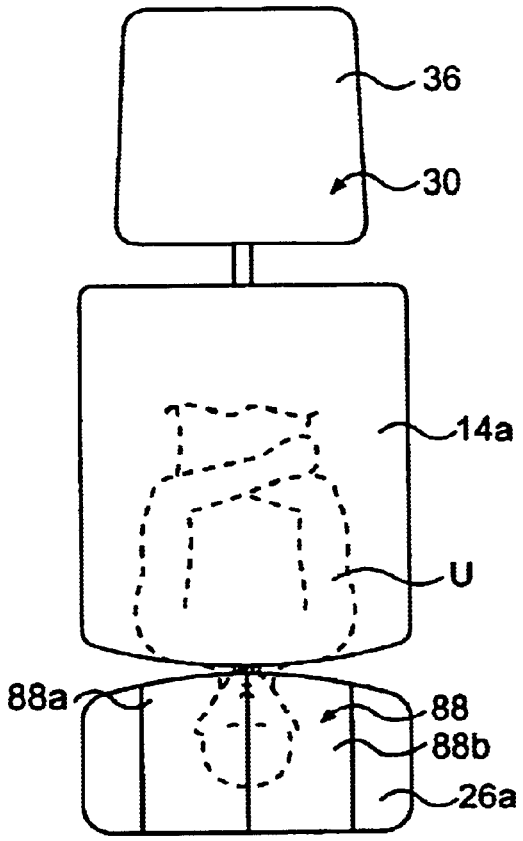
FIGS. 15 and 16 are a top plan view and an end elevational view, respectively, of a modified form of the apparatus of FIG. 1, illustrating yet another mode of operation.
Figure 16:
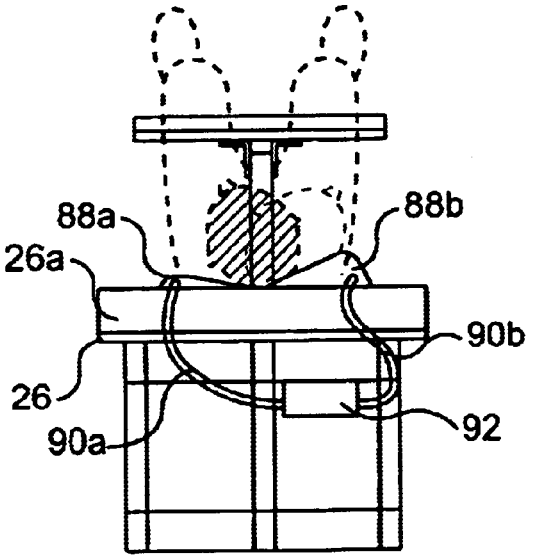

Turning to FIGS. 15 and 16, an embodiment is shown which is somewhat similar to that of FIGS. 13 and 14 wherein support member 26 is provided with an air bladder device 88 used to provide head movement. Bladder device 88 includes two air bladders 88*a* and 88*b* which are disposed in side by side relation, as shown in FIG. 16, and are connected by hoses 90*a* and 90*b* to an air pump 92 with volume, timer and exhaust controls. The pump 92 is used to alternately inflate and deflate bladders 88*a* and 88*b* so that the head is passively moved from side to side as indicated in FIG. 14 and the neck thus exercised by this movement. This can be done in lieu of, or in conjunction with, pivoting movement of the support member 26, depending on the exercise regimen appropriate for the particular user.

Figure 17:
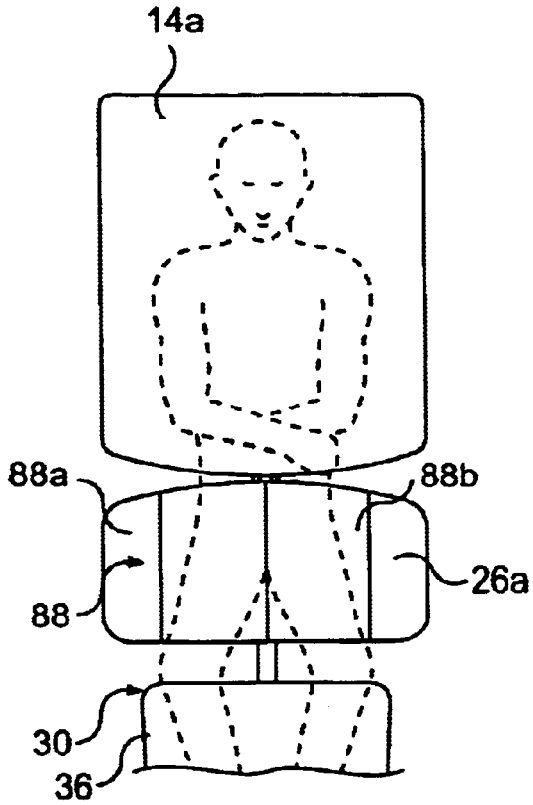
FIGS. 17 and 18 are a top plan view and an end elevational view, respectively, of a further configuration of the apparatus of FIGS. 15 and 16, showing a still further mode of operation.
Figure 18:
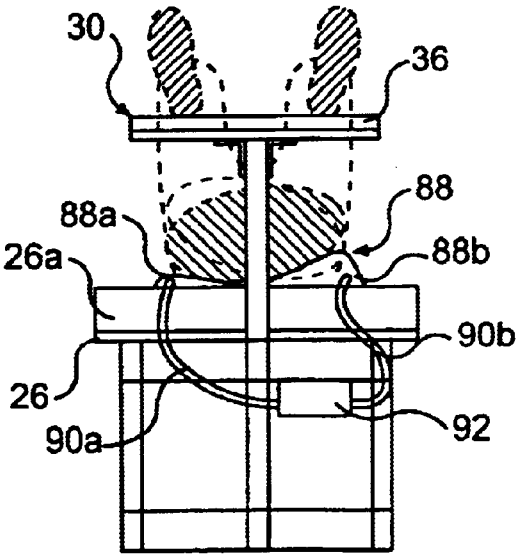

Referring to FIGS. 17 and 18, an embodiment is shown which is similar to that of FIGS. 14 and 15 but in which, instead of the bladder arrangement 88 being used to support the head and neck, the bladder arrangement 88 is used to support the lower trunk. As shown, the leg (calf) support assembly 30 is located at the other end of the device 10 so that the lower trunk rests on pad 26*a* provided on support member 26. This arrangement permits the hips to be rotated as indicated in dashed lines in FIG. 17 by alternatively inflating and deflating bladders 88*a* and 88*b*.

In a non-illustrated embodiment, a further bladder or expandable section (not shown) is provided which is disposed so as to be positioned under, e.g., the upper back of a user between the shoulder blades. The further bladder (not shown) would be inflated and deflated alternately with a neck supporting bladder to provide a gentle rocking motion.

In order to prevent overinflation of a bladder in a situation where a bladder is partially inflated when the machine is turned off (and thus subject to being overinflated when the machine is turned on again and thus the pressure necessary to provide normal full inflation is applied), in accordance with a further, non-illustrated embodiment, the bladders are automatically deflated when the machine is turned off by means, e.g., of a solenoid-controlled actuator providing such deflation.

Figure 19:
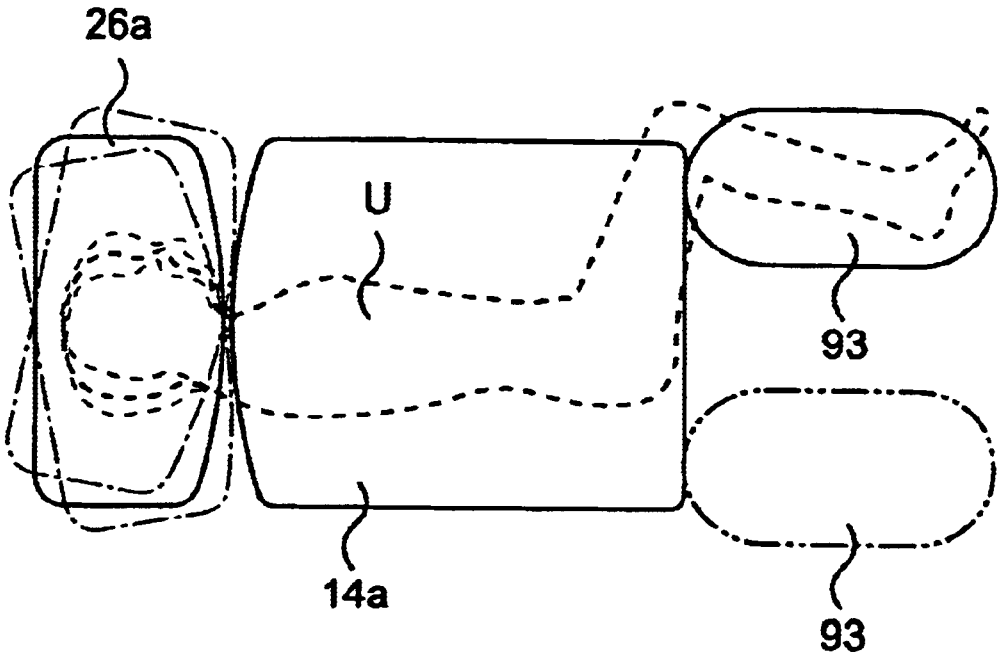
FIGS. 19 and 20 are a top plan view and side elevational view, respectively, of a different configuration of the apparatus of FIGS. 11 and 12, showing another mode of operation.
Figure 20:
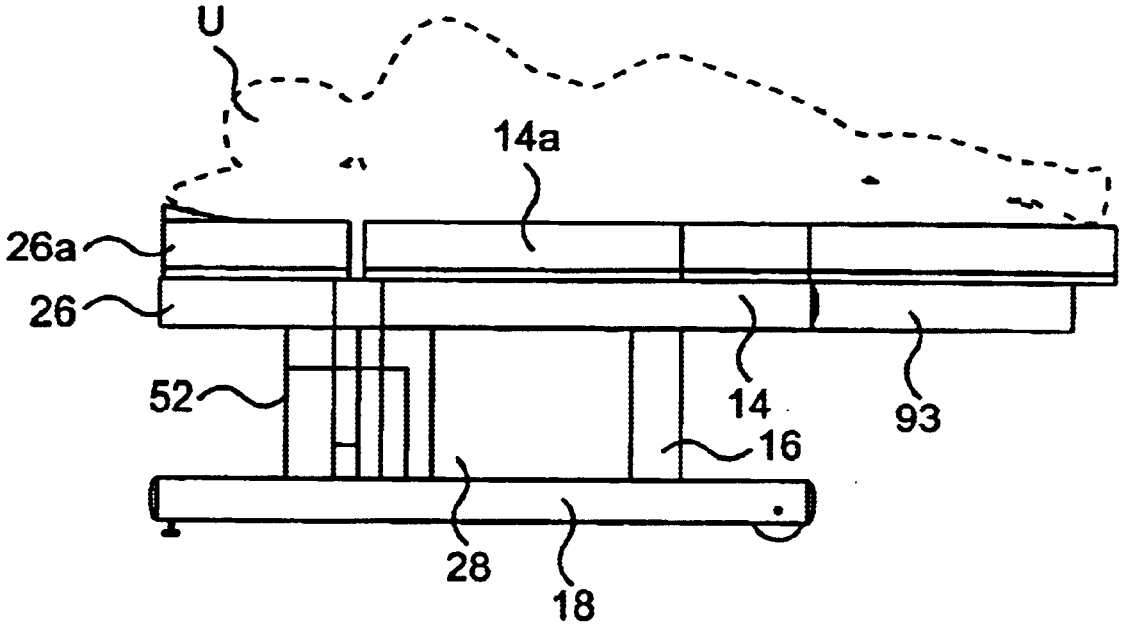

Referring to FIGS. 19 and 20, an embodiment similar to that of FIGS. 11 and 12 is shown. In this embodiment, a leg support member 93, corresponding to leg support member 86 of FIGS. 11 and 12, is affixed to table member 14, rather than auxiliary support member 26 as in FIGS. 11 and 12, and is used to support the legs of user U while the head and neck are moved by pivoting of support member 26 while the user U lies on one side. As indicated in FIG. 18 and was discussed above in connection with FIGS. 11 and 12, leg support member 93 can be positioned at either side of table member 14 so as to permit the user to lie on either side.

Figure 21:
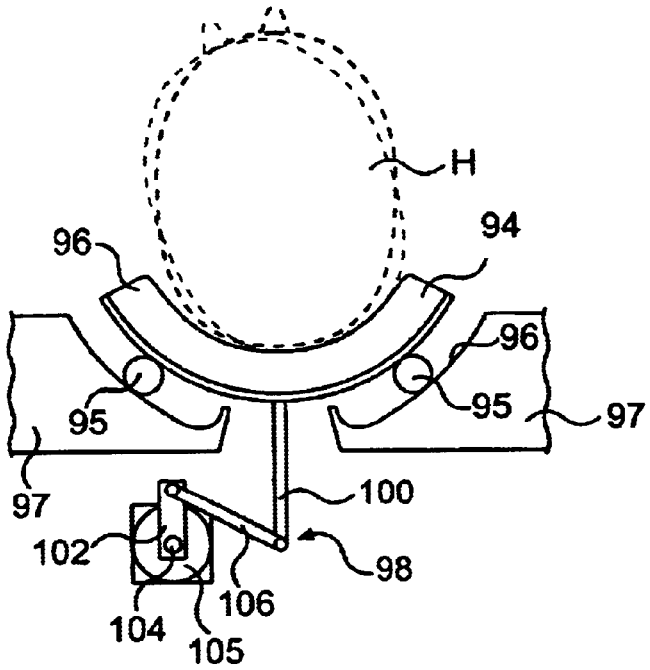
FIG. 21 is an end elevational view of a cervical rotation apparatus in accordance with a further embodiment of the invention.

Referring now to FIG. 21, a further embodiment is shown which is used in providing movement of the head of a user, viz., in providing rotation of the neck or cervix. A cervical support member 94 of a shallow U-shape is used to support the head and neck. Member 94 is supported by, and rolls on, roller bearings 95 which are, in turn, supported in bearing races 96 defined by spaced supports 97. Rotational movement of support member 94 take place under the control of a control mechanism 98. Control mechanism 98 includes a link or arm 100 rigidly affixed to support member 94, a drive or control arm 102 connected to the motor drive shaft 104 of a motor 105 and a linking arm 106 pivotably connected to arms 100 and 102. Control mechanism 98 produces limited rotation of support member 94 so as to gently rotate and exercise the neck.

Figure 22:
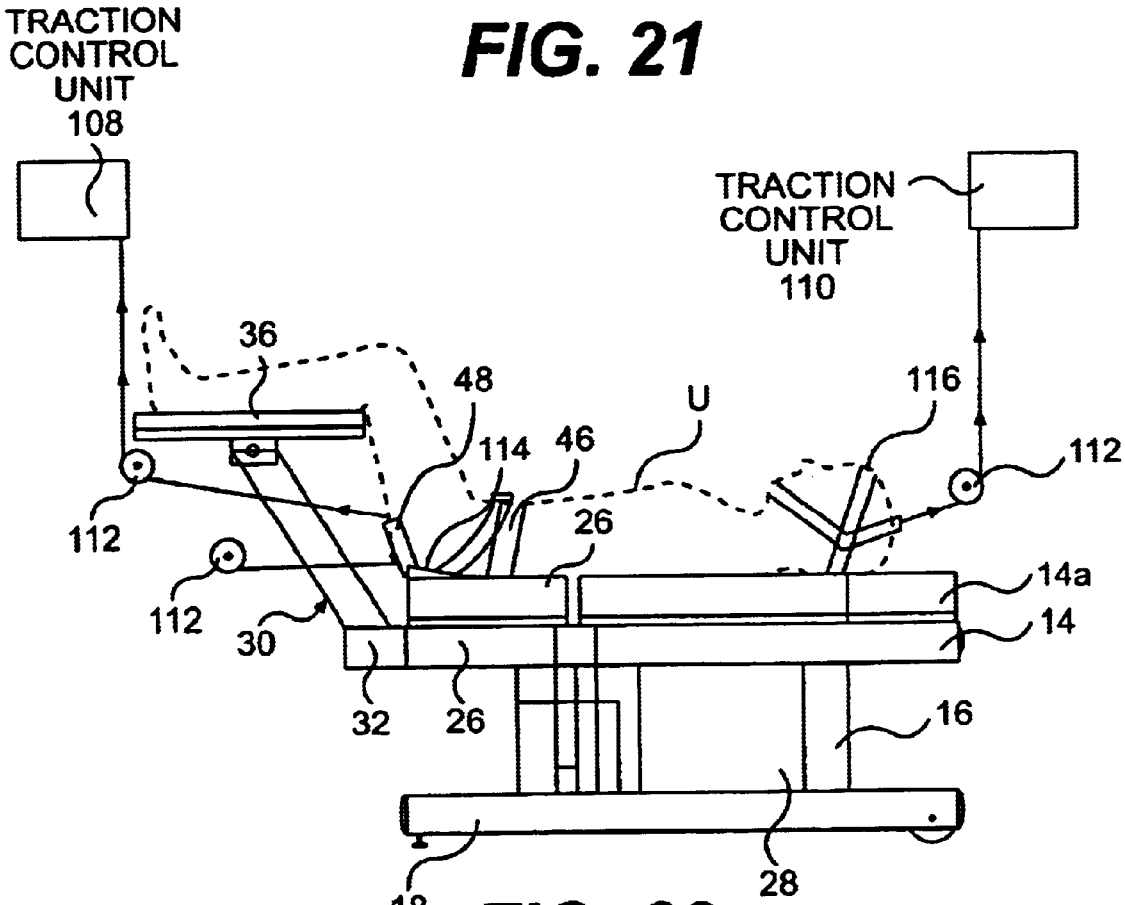
FIG. 22 is a side elevational view of a further modified form of the apparatus of FIG. 1, providing the addition of traction.

Turning to FIG. 22, an embodiment is shown which basically corresponds to that of FIG. 6 and FIGS. 9, 10 but includes a traction arrangement for keeping a user U in traction during the passive movements provided by the device 10 (in this case, movement of the lower trunk and legs). It will, of course, be appreciated that traction can also be provided with other embodiments described above and that other traction arrangements can be used as well. In FIG. 22, both a lumbar traction control device 108 and a cervical traction control 110 are provided. As indicated schematically in FIG. 22, suitable pulleys 112, and separate harnesses 114 and 116 are provided in providing the traction desired.

The passive range of motion control provided by device 10 can be provided on continuous duty basis, with low maintenance requirements and the need for only very occasional lubrication. The mechanisms used afford a very smooth operation, and linear actuators employed preferably have a stroke length of about 5" or 6". The force exerted is preferably no greater than about 50 lbs.

The control unit 28 is adapted to provide push button programmable motion, and is preferably programmable to nine ranges of motion as follows (in degrees): 10–7½–5–2½–0–2½–5–7½–10. The timer used is also programmable, preferably from fifteen minutes to eight hours, and is set to automatically return to zero when the timer times out.

The frame construction of at least the embodiments described above permits the apparatus to be stood on end for storage in a closet or other small area.

The control unit 28 preferably includes an A/B switch or other switching device (not shown) for switching between the linear actuator control (shown, e.g., in FIGS. 5 and 6) and the pneumatic pump control (FIGS. 15, 16 and 17, 18).

Figure 23:
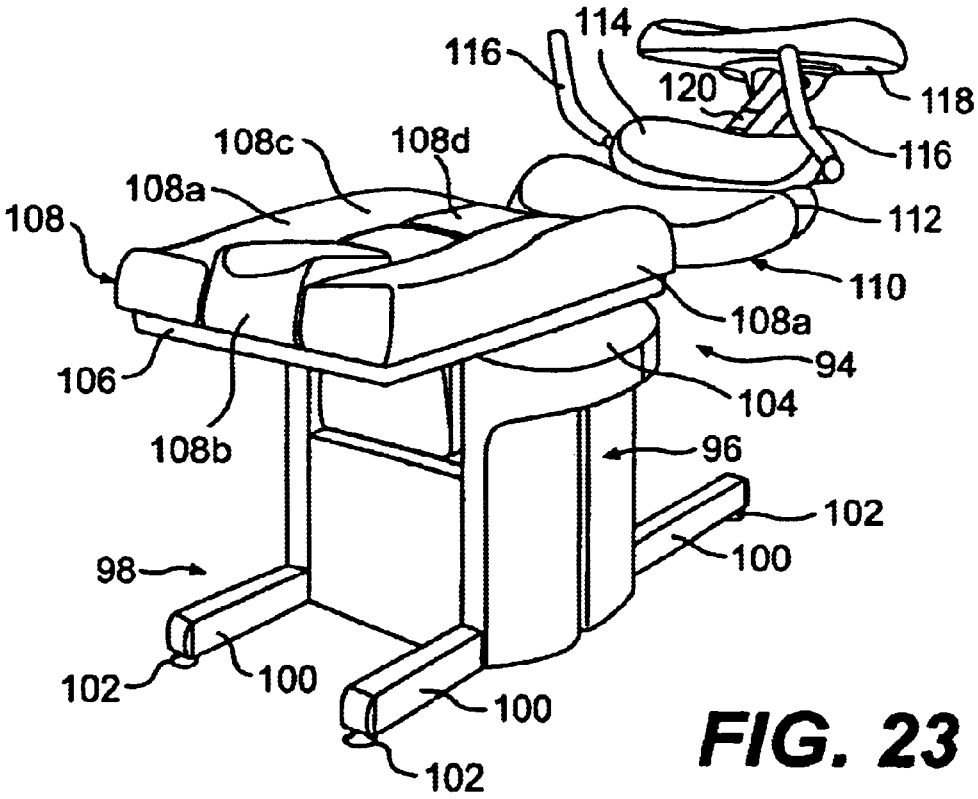
FIG. 23 is a perspective view of the passive range of motion exercise and/or treatment apparatus according to a further embodiment of the invention.
Figure 24:
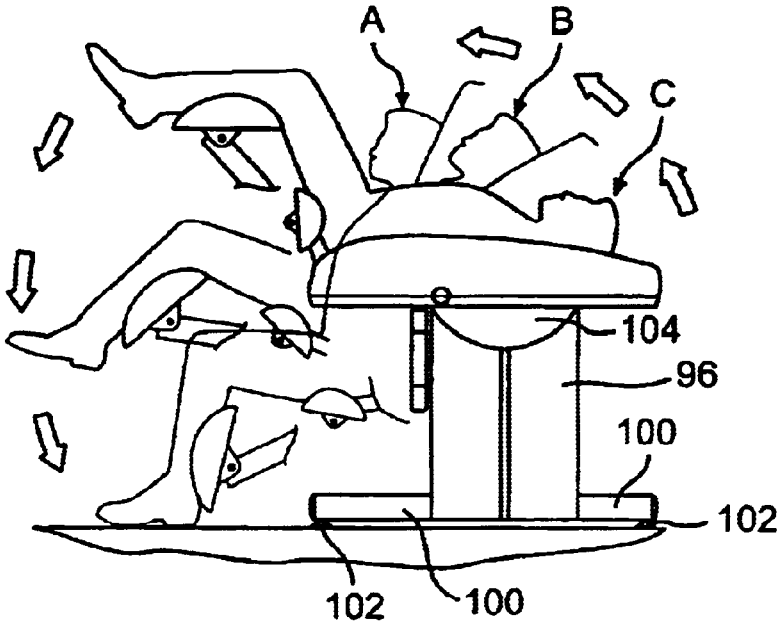
FIG. 24 is a side elevational view of the apparatus of FIG. 23, with parts omitted, illustrating an automated reclining feature thereof.

Referring to FIGS. 23 and 24, there is shown a further embodiment of the invention which is particularly adapted for clinical use. This embodiment is similar to that of FIG. 1 but there are both major and minor differences. The apparatus, which is generally denoted 94, includes a base cabinet 96 and a base 98 formed by two pairs of horizontally extending support legs 100 extending outwardly from cabinet 96 on opposite sides thereof. Levelers 102, corresponding to those described above, are provided at the free ends of support legs 100. A control unit including an external control panel or controls indicated at 104 is housed within cabinet 96. The overall height of apparatus 94 is greater than that of the apparatus of FIG. 1 for reasons which will become apparent.

The apparatus 94 includes a first (table) support member 106 which is similar to that described above and which has seated thereon a body support pad or cushion arrangement 108. In the embodiment illustrated, the latter includes a pair of spaced, laterally disposed contoured pads 108*a*, and a central head rest 108*b* in alignment with a pair of heating and/or cooling units 108*c*, all as described previously.

A second support member 110 is pivotably connected to support member 106 and is controllably pivoted relative thereto, as described above, under the control of control panel 104. Support member 110 includes a contoured covering pad or cushion 112 seated thereon, and affixed thereto, as shown.

A further, separate seat member 114 is affixed to second support member 110 and moves therewith. As shown in FIG. 23, seat member 114 may include laterally disposed, outwardly extending arms 116 at opposite sides thereof which are adapted to be gripped by a user.

A lower leg (calf) support member 118 is affixed to seat member 114 by a support strut 120 and is pivoted in a self-adjusting manner with respect to strut 120, as was described above in connection with FIG. 1 and the related drawing figures.

An important feature of the embodiment of FIGS. 23 and 24 is that, in this embodiment, a reclining functionality is provided wherein, in use of the apparatus 94, the user is first seated on the apparatus or machine in an upright seated position and is then reclined, i.e., passively moved to a reclining 90/90 position, without any effort on his or her part. It will be appreciated that this feature can be of substantial importance in dealing with a seriously ill or infirmed person in that the person does not have to climb onto the machine or be placed on the machine, thereby avoiding stresses that might ordinarily occur with such placement. The first support member 106, second support member 110, seat member 114, and leg support 118 all form a unitary body support unit or construction that is pivotable with respect to base cabinet 96 about a pivot axis indicated at 122. (In FIG. 24, a single seat member 114, which is disposed at a right angle with respect to first support member 106, replaces members 110 and 114 of FIG. 23, for purposes of simplicity.) With the provision of such a pivotable unitary construction, it will be appreciated that, referring to FIG. 24, by effecting simple pivoting of this unitary construction or unit about pivot point 122, a user can be moved from the position indicated at A in FIG. 24 wherein the user is seated on seat member 114 with the backs of the lower portions of his or her legs against leg support 118, and his or her back against first support member 106, through an intermediate position, indicated at B, to a final inclined, "90/90" treatment position, indicated at C, wherein the back of the user rests on support member 106, his or her buttocks abut against seat member 114 and the legs rest on leg support 118. Thus, the entire body support (including the linkage mechanism (not shown) which provides the relative lateral pivoting between sections of the body support as described above) pivots or tilts through 90° relative to the base cabinet 96 and base support 98, which remain stationary.

Although it will be appreciated that a number of different control mechanisms can be used to provide this pivoting or tilting motion, in one preferred embodiment, a linear actuator (not shown), advantageously in the form of an electromechanically activated lead screw device (not shown), would be used. However, again, any conventional control mechanism that is capable of providing smooth controlled pivoting of the body support unit in the manner described would be a suitable candidate for this purpose.

It will be appreciated from the foregoing that the invention is able to provide a large number of different motions. These motions include: lateral side flexion for the lumbar spine; lateral side flexion for the cervical spine; pelvic tilt and rotation; cervical rotation; extension of the trunk; flexion of the trunk; cervical flexion; cervical extension; lumbar distraction; resistive, i.e., interactive exercises for all of the above; and cervical traction. In addition to these motions, the device 10 provides comfortable support of a user while in a static or motionless mode. As indicated above in connection with FIG. 22, the apparatus can be retrofitted with cervical and other traction devices.

Although the invention has been described above in relation to preferred embodiments thereof, it will be understood by those skilled in the art that variations and modifications can be effected in these preferred embodiments without departing from the scope and spirit of the invention.

What is claimed:

1. A passive motion apparatus, said apparatus comprising:

a main support assembly for supporting at least part of the body of a user of the apparatus and including a first support member including a substantially horizontal support surface defining a plane and a second support member including a substantially horizontal support surface disposed in said plane, said second support member being pivotably connected to said first support member and being movable relative thereto such that movement of the second support member with respect to the first support member provides passive movement of a part of the body of a user supported by said second member relative to a part of the body supported by said first support member;

a separable leg support assembly adapted to be connected, in use, to said main support assembly at either end of said main support assembly so as to support at least part of the legs of the user; and motorized drive means for, when activated, providing said movement of said second support member relative to said first support member on a continuous, cyclically repeated basis to provide continuous passive movement of the part of the body supported by said second member.

2. A passive motion apparatus in accordance with claim 1 wherein said leg support assembly includes a support platform and a support strut for, when said leg support assembly is positioned at one end of said main support assembly so as to be disposed adjacent to said second support member, supporting said platform in a plane elevated with respect to the first-mentioned plane such that lower portions of the legs of the user are elevated with respect to the remainder of the body of the user and such that upper portions of the legs of the user extend at substantially right angles with respect to the lower portions of the legs and the trunk of the body of the user.

3. A passive motion apparatus in accordance with claim 2 wherein said leg support assembly further includes means for pivotably mounting said support platform with respect to said support strut so as to enable angular adjustment of the support platform about the support strut.

4. A passive motion apparatus in accordance with claim 1 wherein said leg support assembly comprises a leg support member defining an upper support surface and means for detachably affixing the leg support member to said main support assembly such that said upper surface of said leg support member is disposed substantially in said plane.

5. A passive motion apparatus in accordance with claim 4 wherein said main support assembly has opposite sides and said leg support member is adapted to be selectively connected to said main support assembly at one end thereof on either one of said opposite sides of the main support assembly.

6. A passive motion apparatus in accordance with claim 4 further comprising a further separable leg support assembly adapted to be used when the first-mentioned leg support assembly is not used, said further leg support assembly including a support platform and a support strut for, when said leg support assembly is positioned at a selected end of said main support assembly, supporting said platform in a second plane elevated with respect to the first-mentioned plane such that lower portions of the legs of the user are elevated with respect to the remainder of the body of the user and upper portions of the legs of the user extend at substantially right angles with respect to the lower portions of the legs and the trunk of the body of the user.

7. A passive motion apparatus in accordance with claim 1 wherein said motorized drive means comprises an electric drive motor and control means for selectively controlling the operation of said motor.

8. A passive motion apparatus in accordance with claim 7 wherein said control means comprises programmable means for controlling the motor so as to control the amount of pivoting movement of said second support member relative to said first support member.

9. A passive motion apparatus in accordance with claim 7 wherein said control means includes a stop switch adapted to be operated by a user of the apparatus undergoing said passive movement to terminate the relative movement of said second support member.

10. A passive motion apparatus in accordance with claim 7 wherein said motor comprises a gear head motor and said drive means further comprises a worm screw mounted on said first support member and being driven in rotation by said motor, a traveling nut mounted on said worm screw for travel therealong in response to rotation of said worm screw by said motor, and a link pivotably connected to said traveling nut and to said second support member so as to cause said pivoting movement of said second support member in response to travel of said traveling nut along said worm screw.

11. A passive motion apparatus in accordance with claim 1 further comprising at least one temperature control pack removably disposed on one of said first and second support members.

12. A passive motion apparatus in accordance with claim 11 wherein said temperature control packs comprise one of (i) at least one cold pack and (ii) at least one hot pack.

13. A passive motion apparatus in accordance with claim 1 further comprising a safety belt affixed to said second support member.

14. A passive motion apparatus in accordance with claim 1 further comprising a pair of laterally spaced hand grips affixed to one end of said first support member.

15. A passive motion apparatus in accordance with claim 1 wherein one of said support members includes inflatable means, including first and second alternately inflatable sections, for providing rotational movement of a part of the body received thereon.

16. A passive motion apparatus in accordance with claim 15 wherein said first and second sections comprise first and second inflatable bladders disposed in side by side relation and said inflatable means further comprises an air pump and means for connecting the pump to said bladders so that the pump provides alternate inflation and deflation of said first and second bladders.

17. A passive motion apparatus in accordance with claim 1 wherein one of said support members includes cervical rotation means for, when activated, providing continous cyclically repeated rotational movement of the neck and head of a user between first and second end positions.

18. A passive motion apparatus in accordance with claim 17 wherein said cervical rotation means includes a curved support member in which the head of a user is received, curved race, a plurality of bearings, disposed between said curved support and said curved race, for permitting movement of said curved support member relative to said race, and drive means for producing movement of said curved support member.

19. A passive motion apparatus in accordance with claim 1 wherein said apparatus further comprises traction means for supporting at least one part of the body of a user in traction.

20. A passive motion apparatus for providing passive motion of the lower trunk and legs of a user relative to the remainder of the body of the user, said apparatus comprising:

a first elevated support member for, in use, supporting, a rear portion of the upper trunk of a user and back portion of the head of the user;

a second elevated support member, movable with respect to said first support member, and disposed at a common level with, and adjacent to, said first support member, for, in use, supporting, buttocks down, the lower trunk of the user;

a third elevated support member, disposed in a plane elevated with respect to said common level and disposed adjacent to said second support member, for supporting the lower portions of the legs of the user so that, in use, the upper leg portions of the user extend at substantially 90° to both the lower trunk of the user and the lower portions of the legs of the user; and means for, when activated, providing continuous cyclically repeated pivotable movement of said second support member about a vertical pivot axis between first and second end positions so as to provide continuous passive motion of the lower trunk of the user.

21. A passive motion apparatus in accordance with claim 20 wherein said third elevated support member comprises a support strut, a support platform and includes means for pivotably mounting said support platform with respect to said support strut so as to enable angular adjustment of the support platform about the support strut.

22. A passive motion apparatus in accordance with claim 20 further comprising at least one temperature control pack removably disposed on one of said first and second support members, said at least one temperature control pack comprising one of (i) at least one cold pack and (ii) at least one hot pack.

23. A passive motion apparatus in accordance with claim 20 further comprising a safety belt affixed to said second support member.

24. A passive motion apparatus in accordance with claim 20 wherein said vertical pivot axis is disposed at an end of said second support member adjacent to said first support member and is equispaced from opposed edges of said second support member.

25. A passive motion apparatus in accordance with claim 20 wherein said first support member includes inflatable means, including first and second alternately inflatable sections, for providing rotational movement of the head and neck of the user.

26. A passive motion apparatus in accordance with claim 25 further comprising control means for controlling said inflatable means to produce continuous, cyclically repeated rotational movement of the head and neck of the user between first and second end positions.

27. A passive motion apparatus in accordance with claim 20 wherein said first support member includes cervical rotation means for, when activated, providing continuous, cyclically repeated rotational movement of the neck and head of a user between first and second end positions.

28. A passive motion apparatus, said apparatus comprising:

a main support assembly for supporting at least part of the body of a user of the apparatus and including a first support member including a substantially horizontal support surface defining a first plane and a second support member including a substantially horizontal support surface disposed in said plane, said second support member being pivotably connected to said first support member and being movable relative thereto such that movement of the second support member with respect to the first support member provides passive movement of a part of the body of a user supported by said second member relative to a part of the body supported by said first support member;

a first, separable leg support assembly adapted to be connected, in use, to said main support assembly at either end of said main support assembly so as to support at least part of the legs of the user in a second plane elevated with respect to said first plane;

a further, separable leg support assembly, for use when said first leg support assembly is not being used, said further leg support assembly comprising a leg support member defining an upper support surface and adapted to be connected, in use, to said main support assembly such that said upper surface of said leg support member is disposed substantially in said first plane; and motorized drive means for, when activated, providing continous cyclically repeated movement of said second support member relative to said first support member.

29. A passive motion apparatus in accordance with claim 28 wherein said first leg support assembly includes a support platform and a support strut for, when said leg support assembly is positioned at one end of said main support assembly so as to be disposed adjacent to said second support member, supporting said platform in said second elevated plane such that lower portions of the legs of the user are elevated with respect to the remainder of the body of the user and such that upper portions of the legs of the user extend at substantially right angles with respect to the lower portions of the legs and the trunk of the body of the user.

30. A passive motion apparatus in accordance with claim 29 wherein said first leg support assembly further includes self-adjusting means for pivotably mounting said support platform with respect to said support strut so as to enable angular adjustment of the support platform about the support strut.

31. A passive motion apparatus in accordance with claim 28 wherein one of said support members includes inflatable means, including first and second alternately inflatable sections, for providing rotational movement of a body part received thereon.

32. A passive motion apparatus in accordance with claim 31 further comprising control means for controlling said inflatable means to produce continuous, cyclically repeated rotational movement of the body part between first and second end positions.

33. A passive motion apparatus in accordance with claim 28 wherein one of said support members includes cervical rotation means for, when activated, providing continuous, cyclically repeated rotational movement of the neck and head of a user between first and second end positions.

34. A passive motion apparatus for providing passive motion of the lower trunk and legs of a user relative to the remainder of the body of the user, said apparatus comprising:

a body support unit comprising:

a first support member for, in use, engaging the upper trunk and head of a user;

a second support member, movable with respect to said first support member and disposed adjacent to said first support member, for, in use, engaging the buttocks of the user;

a third support member, disposed adjacent to said second support member in a different plane therefrom, for engaging the lower portions of the legs of the user so that, in use, the upper leg portions of the user extend at substantially 90° to both the lower trunk of the user and the lower portions of the legs of the user; and motor means for, when activated, providing continous cyclically repeated lateral pivotable movement of said second and third support members relative to said first support member; and a stationary base for pivotably supporting said body support unit so as to enable pivoting of said body support unit between a first, substantially vertical position wherein a user is supported in seated posture on said body support unit and a second, substantially horizontal position wherein a user is supported in a reclining posture on said body support unit.

35. A passive motion apparatus in accordance with claim 34 wherein said third support member comprises a support strut, a support platform, and means for pivotably mounting said support platform with respect to said support strut so as to enable angular adjustment of the support platform about the support strut.

36. A passive motion apparatus in accordance with claim 34 wherein said second support member extends outwardly at a non-zero angle with respect to said first support member so as to act as a seat in said first position of said body support unit.

37. A passive motion apparatus in accordance with claim 34 wherein said body support unit includes a fourth support member interposed between said first and second support members and affixed to said second support member for movement therewith so as to undergo lateral pivotable movement with said second support member.

38. A passive motion apparatus in accordance with claim 34 wherein said first support member includes inflatable means, including first and second alternately inflatable sections, for providing rotational movement of a body part received thereon.

39. A passive motion apparatus in accordance with claim 38 further comprising control means for controlling said inflatable means to produce continuous, cyclically repeated rotational movement of the body part between first and second end positions.

40. A passive motion apparatus in accordance with claim 34 wherein said first support member includes cervical rotation means for, when activated, providing continuous, cyclically repeated rotational movement of the neck and head of a user between first and second end positions.

41. A passive motion apparatus, said apparatus comprising:

a main support assembly for supporting at least part of the body of a user of the apparatus and including first, second and third support members for supporting different parts of the body of the user, at least one of said support members being pivotably mounted and being movable relative to the remaining support members of the main support assembly such that movement of the at least one support member with respect to the remaining support members provides passive movement of a part of the body of a user supported by said at least one member relative to a part of the body supported by the remaining support members;

a leg support assembly connected to said main support assembly at one end of said main support assembly so as to support lower portions of the legs of the user in an elevated plane relative to said main support assembly such that the lower portions of the legs of the user are elevated with respect to the remainder of the body of the user and upper portions of the legs of the user extend at substantially right angles to the lower portions; and motorized drive means for, when activated, providing said movement of said at least one support member relative to said remaining support members on a continuous, cyclically repeated basis to provide continuous passive movement of the part of the body supported by said at least one support member;

one of said support members of said main support assembly including cervical rotation means for, when activated, providing continuous, cyclically repeated, rotational movement of the neck and head of the user.

* * * * *